US012606877B2

(12) United States Patent
Wang et al.

(10) Patent No.: US 12,606,877 B2
(45) Date of Patent: Apr. 21, 2026

(54) ULTRA-HIGH PHOSPHORUS MOLTEN IRON LOW-COST SMELTING METHOD FOR POLAR STEEL

(71) Applicants: LAIWU STEEL YINSHAN SECTION CO., LTD., Ji'nan City (CN); SHANDONG IRON AND STEEL CO., LTD., Jinan (CN)

(72) Inventors: Zhongxue Wang, Ji'nan City (CN); Heng Ma, Ji'nan City (CN); Kang He, Ji'nan City (CN); Tengfei Wang, Ji'nan City (CN); Pei Zhang, Ji'nan City (CN); Zhengxu Sun, Ji'nan City (CN); Qingpu Zhang, Ji'nan City (CN); Yuexiang Wang, Ji'nan City (CN); Xiaoxin Huo, Ji'nan City (CN); Yan Li, Ji'nan City (CN)

(73) Assignees: LAIWU STEEL YINSHAN SECTION CO., LTD., Ji'nan City (CN); SHANDONG IRON AND STEEL CO. LTD., Jinan (CN)

( * ) Notice: Subject to any disclaimer, the term of this patent is extended or adjusted under 35 U.S.C. 154(b) by 612 days.

(21) Appl. No.: 17/928,185

(22) PCT Filed: Jun. 7, 2021

(86) PCT No.: PCT/CN2021/098736

§ 371 (c)(1),
(2) Date: Nov. 28, 2022

(87) PCT Pub. No.: WO2022/236900

PCT Pub. Date: Nov. 17, 2022

(65) Prior Publication Data

US 2023/0220504 A1 Jul. 13, 2023

(30) Foreign Application Priority Data

May 20, 2021 (CN) ..... 202110553104.5

(51) Int. Cl.

| | |
|---|---|
| ***C21C 7/06*** | (2006.01) |
| ***C21C 5/34*** | (2006.01) |
| ***C21C 5/36*** | (2006.01) |
| ***C21C 7/00*** | (2006.01) |
| ***C21C 7/10*** | (2006.01) |

(52) U.S. Cl.

CPC ..... *C21C 7/06* (2013.01); *C21C 5/34* (2013.01); *C21C 5/36* (2013.01); *C21C 7/0006* (2013.01); *C21C 7/0087* (2013.01); *C21C 7/10* (2013.01); *C21C 2007/0093* (2013.01)

(58) Field of Classification Search

CPC .... C21C 7/06; C21C 5/34; C21C 5/36; C21C 7/0006; C21C 7/0087; C21C 7/10; C21C 2007/0093; C21C 7/0075; C21C 7/0056; C21C 7/064; C21C 7/072; C22C 38/02; C22C 38/04; C22C 38/06; C22C 38/12; C22C 38/14; C22C 38/002; Y02P 10/20

USPC ..... 75/512

See application file for complete search history.

(56) References Cited

U.S. PATENT DOCUMENTS

2023/0098225 A1* 3/2023 Ma ..... C21D 8/0226 148/546

FOREIGN PATENT DOCUMENTS

| | | | |
|---|---|---|---|
| CN | 106884067 | A | 6/2017 |
| CN | 109280731 | A | 1/2019 |
| CN | 109402323 | A | 3/2019 |
| CN | 109593907 | A | 4/2019 |
| CN | 109778054 | A | 5/2019 |
| CN | 109897933 | A | 6/2019 |
| CN | 111363889 | A | 7/2020 |
| CN | 112048665 | A | 12/2020 |

* cited by examiner

*Primary Examiner* — Danielle M. Carda
(74) *Attorney, Agent, or Firm* — Spencer Fane LLP

(57) ABSTRACT

An ultra-high phosphorus molten iron low-cost smelting method for polar steel includes successively deoxidizing and tapping alloying raw materials including molten iron; performing slag adjusting and refining on the molten steel obtained in the converter smelting step to obtain a refined molten steel; vacuum degassing the refined molten steel; and performing continuous casting on the molten steel obtained after the RH degassing step to obtain a cast billet.

18 Claims, No Drawings

ULTRA-HIGH PHOSPHORUS MOLTEN IRON LOW-COST SMELTING METHOD FOR POLAR STEEL

CROSS-REFERENCE TO RELATED APPLICATION

This application is a U.S. National Stage application of International Application PCT/CN2021/098736, filed Jun. 7, 2021, which claims priority to Chinese Application No. 202110553104.5, filed May 20, 2021, the contents of each of which are hereby incorporated by reference.

BACKGROUND

Technical Field

The disclosure is related to the field of ferrous metallurgy, in particular to an ultra-high phosphorus molten iron low-cost smelting method for polar steel.

Background

With the increasing shortage of energy in the world, countries have successively increased the development of polar oil and gas energy and built many offshore platforms, and the demand for ultra-low temperature resistant steel for polar use has soared. Due to the extremely low polar temperature, the content of phosphorus in steel is very important to the toughness of steel, however, the content of phosphorus in domestic molten iron varies greatly, some steel mills are affected by ore raw materials, and the ultra-high phosphorus molten iron produced is not suitable for the production of low phosphorus steel, which has significantly slowed the pace of production.

SUMMARY

With the increasing demand for low-phosphorus high-quality steel, how to use converters to achieve such ultra-high phosphorus hot metal smelting polar low-phosphorus steels at the lowest cost is the focus of research at this stage. At present, some enterprises at home and abroad widely use converter duplex method to produce low-phosphorus steel, such as LD-NRP method of JFE, H converter of Kobe steel, BRP method of Baosteel, etc. It has been determined that such conventional processes have high requirements for equipment, and in the process of converter molten iron transferring, the heat loss is large and the production efficiency is low. There is also a double-slag method that continuously performs dephosphorization and decarburization of molten iron on the same converter, which is simple to operate and does not require new equipment, and has been widely used at home and abroad.

Although there are many patents on smelting low-phosphorus steel with high-phosphorus molten iron, such smelting process has the disadvantages of long process flow and high cost. Several similar patents are briefly described below.

Patent document CN 109593907A discloses "a method for smelting low-phosphorus steel", which produces finished products of qualified billet with P≤0.005% by controlling the converter blowing lance position, oxygen supply intensity, bottom blowing flow, and slag control under tapping, but this method is only applicable to molten iron with phosphorus content less than or equal to 0.10%.

Patent document CN 109897933A discloses "a high-efficiency smelting process for producing low-phosphorus clean steel in a converter", which smelts low-phosphorus steel by a converter double-slag method, but it has been determined that the phosphorus content of molten iron used in the smelting method is all less than 0.13%, and the residual slag treatment is easy to produce phosphorus back phenomenon, which is not suitable for ultra-high phosphorus hot metal smelting.

Patent document CN 109402323A discloses "a method for smelting ultra-low phosphorus steel with ultra-high phosphorus molten iron". This patent optimizes the ratio of lime ash and slag modification agent in the LF refining process, and adjusts the composition of the steel slag to increase the phosphorus content of the steel slag capacity, thereby increasing the distribution ratio of phosphorus in steel slag and molten steel, providing favorable conditions for dephosphorization. However, it has been determined that the smelting method does not describe the converter smelting process in detail, and the P content in the molten steel in the LF converter is at a low level, and the LF refining process takes too long, which is not conducive to high-efficiency and low-cost batch industrial production.

In view of the deficiencies of the prior art, the purpose of this disclosure is to provide an ultra-high phosphorus molten iron low-cost smelting method for polar steel, which can realize the requirement of using molten iron with a phosphorus content higher than 0.150% to smelt steel with a phosphorus content of less than 0.007%, and can significantly reduce the ductile-brittle transition temperature of steel, and meet the requirements of polar and extremely cold working conditions.

To achieve the above object, the present disclosure adopts the following technical solutions:

An ultra-high phosphorus molten iron low-cost smelting method for polar steel, comprising successively:

converter smelting step: smelting, deoxidizing and tapping alloying w materials including molten iron;

LF refining step: performing slag adjustment and refining on the molten steel obtained in the converter smelting step to obtain a refined molten steel;

RH degassing step: vacuum degassing the refined molten steel;

continuous casting step: performing continuous casting on the molten steel obtained after the RH degassing step to obtain a cast billet.

In the above-mentioned ultra-high phosphorus molten iron low-cost smelting method for polar steel, as a preferred embodiment, in the converter smelting step, when the content of P element in the molten iron as the raw material is ≥0.15 wt %, the content of Si element is 0.15-0.6 wt %, the content of S element is ≤0.006 wt %, and the content of As element is ≤0.006 wt %; preferably, the temperature of the molten iron is ≥1230° C.; if the molten iron temperature is too low, it may cause problems such as serious molten steel back-blowing, large blowing loss, high steel material consumption, high cost, unsecured molten steel quality, and reduced converter age.

In the above-mentioned ultra-high phosphorus molten iron low-cost smelting method for polar steel, as a preferred embodiment, in the converter smelting step, when the mass content of silicon in the molten iron as a raw material is ≥0.30%, the raw material also comprises scrap steel ; preferably, the mass of scrap steel/(mass of molten iron+scrap steel)≤8%.

In the above-mentioned ultra-high phosphorus molten iron low-cost smelting method for polar steel, as a preferred embodiment, in the converter smelting step, carrying out the smelting by using a double-slag process when the mass content of silicon in the molten iron as raw material is <0.30%; preferably, the double-slag process specifically includes: step 1): adding a part of the slag to the raw material, and then blowing oxygen into the raw material by using an oxygen lance, after the primary slag is completely smelted, taking the oxygen lance out of the converter and pouring the slag; step 2): using the oxygen lance to blow oxygen into the molten steel obtained in step 1), and then adding the remaining slag in batches, and continuing the smelting, during the process, measuring the TSC temperature and content of C of the molten steel, and selecting lime or sinter ore to be added according to the measurement results to ensure the alkalinity in the later stage and promote the slag smelting.

preferably, in step 2), the time from adding the remaining slag to measuring the TSC temperature and content of C of the molten steel is 70-90 s.

preferably, in step 2), the total time of blowing oxygen (i.e. the total reaction time of the step 2)) is 240-300 s.

preferably, the slag includes a slag-forming agent and a coolant; preferably, the slag-forming agent is lime and dolomite; the coolant is sinter ore; preferably, in the step 1), the addition amount of lime is 20-22.5 kg/ton steel, the addition amount of dolomite is 3.5-5.5 kg/ton steel, and the addition amount of sinter ore is 28.5-32 kg/ton steel;

preferably, in step 1), the time for blowing oxygen is 5-6 min;

preferably, in step 1), after the slag is completely smelted, the oxygen lance is lifted out of the converter within 15-30 s;

Preferably, in step 2), the addition amount of lime is 21-25 kg/ton steel, the addition amount of dolomite is 3.5-5.0 kg/ton steel, and the addition amount of sinter ore is 14-20 kg/ton steel;

preferably, in step 2), the TSC temperature is controlled to 1540° C. to 1590° C., and the carbon content is controlled to 0.25 wt %-0.40 wt %., preferably, when TSC≤1540° C., adding the lime and continuing oxygen blowing smelting; when TSC is ≥1590 ° C., adding sinter ore.

preferably, in step 2), selecting to add lime or sinter ore to continue the blowing according to the measured TSC temperature result, so as to ensure that the TSO temperature of the converter is controlled to 1600° C.-1650° C., and the carbon content is controlled to 0.07 wt %-0.09 wt %; preferably, performing spot blowing and temperature increasing if the TSO temperature of the converter is less than 1600° C.

In the above-mentioned ultra-high phosphorus molten iron low-cost smelting method for polar steel, as a preferred embodiment, in the converter smelting step, when the content of silicon in the molten iron as a raw material is <0.30%, the raw material comprises molten iron and scrap steel;

preferably, the mass ratio of scrap steel to the raw material is ≤8%.

In the above-mentioned ultra-high phosphorus molten iron low-cost smelting method for polar steel, as a preferred embodiment, in the converter smelting step, carrying out the smelting by using a single-slag process when the mass content of silicon in the molten iron as raw material is <0.30%; preferably, the single-slag process specifically includes: step a):adding lime, sinter ore and dolomite to the raw material, step b) after the slag is completely smelted in the whole process, measuring TSC, and then selecting to add lime or sinter ore according to the measured TSC temperature result;

preferably, in step a), the lime is added in 2-3 batches, and the addition amount of ton steel is 42.9-46.2. kg/t (that is, add 42.9-46.2 kg per ton of molten iron); preferably, the sinter ore is added in 3-4 batches, the addition amount of ton steel is 39.2-42.8 kg/t; preferably, the dolomite is added in 2-3 batches, and the addition amount of ton steel is 8.57-10.7 kg/t;

preferably, in step b), the addition amount of the lime or sinter ore is 2.15-3.57 Kg per ton of the molten iron; preferably, when the measured TSC is ≤1540° C., adding the lime and continuing oxygen blowing smelting; when the measured TSC is ≥1590 ° C., adding sinter ore as a coolant to control the reaction rhythm;

preferably, in step b), if the Content of C is ≥0.10% according to the TSO measurement result, performing spot blowing to control the contents of C and P contents of the molten steel.

In the above-mentioned ultra-high phosphorus molten iron low-cost smelting method for polar steel, as a preferred embodiment, in the converter smelting step, blowing nitrogen and argon at the bottom of the converter during the whole smelting process.

In the above-mentioned ultra-high phosphorus molten iron low-cost smelting method for polar steel, as a preferred embodiment, in the converter smelting step, in the first 7-8 minutes of smelting, blowing nitrogen at the bottom, wherein flow rate of nitrogen is 450-580 Nm3/h in the first 1-3 min, and the flow rate of nitrogen in the later stage is increased to 800-900 Nm3/h (the volume of nitrogen is: the gas volume under the pressure is one atmosphere pressure, and the temperature is 0° C.); after bottom blowing nitrogen for 7-8 minutes of smelting, switching to argon, and increasing the flow rate of argon to 1000-1100 Nm3/h; in the early stage of blowing, the stirring of molten pool is strengthened to promote lime melting and increase slag formation rate; at the end of blowing and refining, the stirring intensity of molten pool is increased, the reaction balance of slag steel is promoted, and the dephosphorization effect is strengthened.

In the above-mentioned ultra-high phosphorus molten iron low-cost smelting method for polar steel, as a preferred embodiment, in the converter smelting step, when the carbon-oxygen equilibrium of the converter is ≤0.0021 and the carbon at the measuring end point of the converter is ≤0.045%, taping the steel directly; when the carbon-oxygen equilibrium of the converter is >0.0032, the TSO composition of the converter needs to be determined as C: 0.06-0.09 wt %, P≤0.006 wt %, S≤0.020 wt %, then the steel can be tapped; when the carbon-oxygen equilibrium of the converter is between 0.0021-0.0032, the carbon at the measuring end point of the converter needs to be ≤0.045%, otherwise, spot blowing.

In the above-mentioned ultra-high phosphorus molten iron low-cost smelting method for polar steel, as a preferred embodiment, in the converter smelting step, after the smelting and before the deoxidizing, using a high-low-low lance level (2000 mm-1500 mm-500 mm) to perform slag splashing and converter protection using nitrogen, repeatedly lifting lance during the process of slag splashing, after the slag splashes dry, closing the nitrogen and lifting lance, and the time of the slag splashing is 140-200 s; embodiments of the invention adopt three-stage lance positions to realize slag splashing in the whole converter, and the thickness uniformity of slag splashing is good; compared with oxygen, strong redox reaction occurs, which is not suitable for slag splashing and converter protection, and argon gas is expensive, and economical is poor. Embodiments of the invention adopt nitrogen slag splashing to protect the converter, which can make full use of the high basicity final slag of the converter and the nitrogen by-product of the oxygen production plant, and the cost is low.

In the above-mentioned ultra-high phosphorus molten iron low-cost smelting method for polar steel, as a preferred embodiment, in the converter smelting step, the deoxidation is carried out with Ferro-manganese-aluminum added in an amount of 1.7-2.5 kg/t of steel.

In the above-mentioned ultra-high phosphorus molten iron low-cost smelting method for polar steel, as a preferred embodiment, in the converter smelting step, the alloys used in the alloying include: metal manganese, ferrosilicon, ferroniobium, ferrovanadium and nickel plate.

In the above-mentioned ultra-high phosphorus molten iron low-cost smelting method for polar steel, as a preferred embodiment, in the LF refining step, the substances used for the slag adjusting are aluminum slag and calcium carbide, preferably, the substances used for the slag adjusting further comprise lime; preferably, the slag is adjusted to a final slag alkalinity of ≥2.2, and the top slag before leaving the station must be a yellow-white slag or a white slag, and the retention time of the yellow-white slag or the white slag is not less than 10 minutes.

In the above-mentioned ultra-high phosphorus molten iron low-cost smelting method for polar steel, as a preferred embodiment, in the LF refining step, after the slag adjusting, an aluminum wire is fed for aluminum enrichment, and a titanium wire is fed for titanium enrichment.

In the above-mentioned ultra-high phosphorus molten iron low-cost smelting method for polar steel, as a preferred embodiment, in the LF refining step, the time of the refining is 30-45 min; In the above-mentioned ultra-high phosphorus molten iron low-cost smelting method for polar steel, as a preferred embodiment in the LF refining step, the mass ratio of the slag material used for the slag adjusting is: lime: fluorite:calcium carbide:aluminum slag=(3-5):(3-5):1:(1-2), preferably, lime:fluorite:calcium carbide:aluminum slag=(4-5):(4-5):1:(1-2).

In the above-mentioned ultra-high phosphorus molten iron low-cost smelting method for polar steel, as a preferred embodiment, in the RH degassing step, when the vacuum degassing is performed, the degree of vacuum is ≤1.33 Pa, the circulation time is not less than 15 minutes, and the degassing time is greater than 5 minutes.

In the above-mentioned ultra-high phosphorus molten iron low-cost smelting method for polar steel, as a preferred embodiment, in the RH degassing step, after the vacuum degassing, feeding calcium aluminum wire 80-100 m/converter, and blowing softly is no less than 10 minutes.

In the above-mentioned ultra-high phosphorus molten iron low-cost smelting method for polar steel, as a preferred embodiment, in the continuous casting step, the superheat of the molten steel is controlled <25° C.

In the above-mentioned ultra-high phosphorus molten iron low-cost smelting method for polar steel, as a preferred embodiment, in the continuous casting step, for 175 section, the pulling speed during continuous casting is 1.25-1.35 m/min; for 200 section, the pulling speed during continuous casting is 1.2-1.4 m/min; for 250 section, the pulling speed during continuous casting is 1.14.3 m/min; for 300 mm section, the pulling speed during continuous casting is 0.85-0.95 m/min;

In the above-mentioned ultra-high phosphorus molten iron low-cost smelting method for polar steel, as a preferred embodiment, in the continuous casting step, the crystallizer is made of peritectic steel to protect slag; the middle ladle is covered with a covering agent combined with carbonized rice husks to ensure good coverage of the liquid surface of the middle ladle: the long nozzle of the large ladle is sealed with argon, and the flow rate is 90-120 L/min; if the flow rate is less than 90 L/min, it is difficult to isolate the air, and if the flow rate is greater than 120 L/min, the argon gas will be wasted.

In the above-mentioned ultra-high phosphorus molten iron low-cost smelting method for polar steel, as a preferred embodiment, the content of P in the steel component obtained by the smelting method is less than 0.007% by mass percentage; more preferably, in mass percentage, the steel composition obtained by the smelting process comprises: C: 0.06-0.10%, Si: 0.20-0.35, Mn: 1.5-1.65%, Nb: 0.010-0.030%, V: 0.010-0.035%, Ti: 0.010-0.035%, Al: 0.015-0.040%.

Compared with the prior art, the beneficial effects of the present disclosure are:

1. The method for smelting low-phosphorus steel with ultra-high-phosphorus molten iron of polar steel described in the present disclosure determines whether to adopt the double-slag process according to the silicon content in the molten iron, if the silicon content in the molten iron is ≥0 30%, the converter is adopted the double-slag process: if the silicon content in the molten iron is <0.30%, the converter is adopted the single-slag process, and then the refining deep dephosphorization process to further dephosphor, this method can realize continuous and stable smelting of steel with phosphorus content less than 0.007% using ultra-high phosphorus molten iron as slag, and the consumption of required excipients is low, the production pace is fast, and it has broad promotion prospects.
2. According to the Si content of molten iron, the smelting in single and double slag areas can be distinguished, which greatly saves the consumption of smelting slags, shortens the smelting cycle, and speeds up the production process.
3. For ultra-high-P molten iron, the optimized slag-forming material ratio and reasonable oxygen blowing flow and oxygen-blowing time are used to obtain ultra-low phosphorus molten iron through converter smelting.
4. In the LF refining stage, adopt a reasonable slag material ratio and smelting method to reduce the amount of molten steel returned to P.
5. The method for smelting low-phosphorus steel with ultra-high-phosphorus molten iron of polar steel described in this application is relatively inexpensive, and the process is simple and easy to operate in extreme cold conditions and high comprehensive performance requirements in engineering.
6. After the billet smelted and continuously casted by this method, after rolling, the yield strength of the steel plate is ≥420 MPa, the tensile strength is 520-680 MPa, the impact energy at −52° C. is ≥100 J, and the area shrinkage rate is ≥19%.

DETAILED DESCRIPTION OF THE EMBODIMENTS

In order to highlight the purpose, technical solutions and advantages of the present disclosure, the present disclosure is further described below with reference to the embodiments, which are expressed by way of explanation of the present disclosure rather than limiting the present disclosure. The technical solutions of the present disclosure are not limited to the specific embodiments listed below, but also include any combination of specific embodiments.

Any feature disclosed in this specification, unless expressly stated otherwise, may be replaced by other equivalent or alternative features serving a similar purpose. Unless stated otherwise, each feature is only one example of a series of equivalent or similar features.

Example 1

An ultra-high phosphorus molten iron low-cost smelting method for polar steel:

(1) Converter Smelting

Using a 140 t top-bottom double blowing converter, the raw material composition is: 141 t high phosphorus desulfurization molten iron (C: 5.65%, Mn: 0.213%, P: 0.151%, 5: 0.002%, Si: 0.54%, As: 0.0020%, molten iron temperature 1310° C.), the amount of scrap steel is 10 t. The double-slag process is used for smelting, during the smelting, the oxygen is first blown out of the lance, and the lance position is controlled at about 1500 mm. After the oxygen lance is fired, the flow rate of the oxygen lance is adjusted to about 25000 m3/h, the lance position is 1800 mm, 3050 kg of lime, 3600 kg of sinter ore and 400 kg of dolomite are added, the first batch of materials is added 150 s before blowing. 30 seconds after the primary slag is completely melted, lift the lance to pour the slag, and the timing of lifting the lance is about 5 minutes in principle.

Switch the oxygen after the nitrogen slag is fired for the second time, after the oxygen lance is fired, the flow rate of the oxygen lance is adjusted to about 24500 m3/h, and the lance position is about 1700 mm, then, a total of 3200 kg of lime, 2700 kg of sinter and 550 kg of dolomite are added in batches, while avoiding blowing and drying. The TSC temperature is 1540° C.-1590° C., and the carbon content is controlled at 0.25%-0.40%, after the TSC is measured, 11.50 kg lime is added to adjust the TSO temperature to 1600° C.-1650° C. Finally, the high-low-low lance position (2000 mm-1500 mm-500 mm) is used to splash the slag to protect the converter, the lance is repeatedly lifted and pressed in the slag splashing process, after the slag is dried, the nitrogen is turned off and the lance is lifted, the slag splashing time is 186 s. When the carbon-oxygen equilibriums of the converter are ≤0.0021 and the carbon at the measuring end point of the converter is ≤0.045 wt %, the tapping temperature of the converter is 1620° C., and when tapping, 260 kg of aluminum-manganese-iron, 2100 kg of metallic manganese, 120 kg of nickel plate, 60 kg of vanadium-iron, 50 kg of ferroniobium and 440 kg of ferrosilicon are added; 600 kg of synthetic slag and 200 Kg of pre-melted slag are added along the steel flow.

Bottom blowing nitrogen and argon during the whole smelting process, and bottom blowing nitrogen during the first 8 minutes of smelting, wherein the first 3 min nitrogen flow rate is 500 m3/h, and the last 5 min nitrogen flow rate is increased to 850 m3/h; nitrogen is blown at the bottom of smelting for 8 minutes and switched to argon gas, and the flow rate of argon gas is increased to 1050 m3/h.

(2) LF Smelting

Adding 200 kg of lime, 200 kg of fluorite, 50 kg of calcium carbide and 80 kg of aluminum slag for if refining to adjust the slag; an 150 m aluminum wire is fed for aluminum enrichment, and a 130 titanium wire is fed for titanium enrichment. The final slag alkalinity is controlled above 2.2.

During the whole smelting process, argon is blown at the bottom and stirred, the argon pressure can be appropriately increased in the early stage, and a soft blowing with a small pressure is used before going out to ensure that the inclusions float up, the time for refining the soft blowing argon is 5 minutes, and the total refining time is 45 minutes.

(3) RH Smelting

During RH treatment, the insertion depth of dip tube is 400 mm; in the treatment, the vacuum degree is 30 Pa, the circulation time is 22 min, and the pure degassing time is 10 min. At the end of RH treatment, calcium aluminum wire 90 m/converter is fed, soft blowing is performed for 10 minutes, and the RH smelting cycle is 23 minutes.

(4) Continuous Casting

The crystallizer is made of peritectic steel to protect slag; the middle ladle is covered with a covering agent combined with carbonized rice husks to ensure good coverage of the liquid surface of the middle ladle. The long nozzle of the large ladle is sealed with argon, and the flow rate is 90/min, the crystallizer uses a non-sinusoidal oscillation mode. The cross-sectional size of the continuous casting billet is 250 mm*2400 mm and the pulling speed is 1.1 to/min.

At the end of the number of castings, C: 0.07%, Si: 0.28%, Mn: 1.52%, P: 0.006%, S: 0.001%, Nb: 0.025%, Ti: 0.015%, V: 0.025%, Ni: 0.11%, Als: 0.020%; the consumption of this converter is: lime 48.53 kg/ton steel, total slag consumption 54.41 kg/ton steel, oxygen consumption 47.05 Nm3/ton steel.

Five number of castings of steel are produced by the method of this example, the content of P in the steel are all less than 0.007 wt %, and after rolling, the resulting steel billet had a yield strength of 425-510 MPa, a tensile strength of 520-590 MPa, an impact energy of 150-210 J at −60 C, and the area shrinkage rate is 22-32%.

Example 2

An ultra-high phosphorus molten iron low-cost smelting method for polar steel:

(2) Converter Smelting

Using a 140 t top-bottom double blowing converter, the slag composition is: 141 t high phosphorus desulfurization molten iron 92% (C: 4.437%, Mn: 0.213%, P: 0.148%, S: 0.003%, Si: 0.294%, As: 0.0018%, molten iron temperature 1316° C.), the balance is scrap. In the smelting process, the single-slag process is adopted, and the lance position is controlled at about 1500 mm during the lance blowing stage under oxygen; after the oxygen lance is fired, the oxygen lance flow is adjusted to about 26000 m3/h, the lance position is 1800 mm, and the oxygen supply pressure is 0.8 MPa; in the early 8 minutes of smelting, the bottom blowing nitrogen, the nitrogen bottom blowing flow rate is 560 m3/h, and then increases to 880 m3/h, after the bottom blowing for 8 minutes, it is switched to argon gas, the flow rate is increased to 1200 m3/h, 6200 kg of sinter ore, Lime 6040 kg, dolomite 800 kg are added, to ensure the alkalinity in the later stage and promote the slag smelting; the final lance position is controlled at about 1200 mm. Finally, the high-low-low lance position (2000 mm-1500 mm-500 mm) is used to splash the slag and protect the converter, the lance is repeatedly lifted and pressed in the slag splashing process, after the slag is dried, the nitrogen is turned off and the lance is lifted, the slag splashing time is 163 s. The tapping temperature of the converter is 1646° C., and when tapping, 240 kg of aluminum-manganese-iron, 2040 kg of metallic manganese, 120 kg of nickel plate, 60 kg of vanadium-iron, 50 kg of ferroniobium and 440 kg of ferrosilicon are added; 600 kg of synthetic slag and 200 Kg of pre-melted slag are added along the steel flow.

(2) Lf Smelting

Adding 352 kg of lime, 157 kg of fluorite, 180 kg of calcium carbide and 20 kg of aluminum slag for LF refining to adjust the slag; an 120 m aluminum wire is fed for aluminum enrichment, and a 150 titanium wire is fed for titanium enrichment. The final slag alkalinity is controlled above 2.2.

During the whole smelting process, argon is blown at the bottom and stirred, the argon pressure can be appropriately increased in the early stage, and a soft blowing with a small pressure is used before going out to ensure that the inclusions float up, the time for soft argon blowing is 5 minutes, and the total smelting time is 42 minutes.

(3) RH Smelting

During RH smelting, the insertion depth of dip tube is 400 mm; in the treatment, the vacuum degree is 30 Pa, the circulation time is 22 min, and the pure degassing time is 10 min. At the end of RH treatment, calcium aluminum wire 80 m/converter is fed, soft blowing is performed for 10 minutes, and the RH smelting cycle is 22 minutes.

(4) Continuous Casting

The crystallizer is made of peritectic steel to protect slag; the middle ladle is covered with a covering agent combined with carbonized rice husks to ensure good coverage of the liquid surface of the middle ladle. The long nozzle of the large ladle is sealed with argon, and the flow rate is 90/min, the crystallizer uses a non-sinusoidal oscillation mode. The cross-sectional size of the continuous casting billet is 300 mm, and the pulling speed is 0.85 m/min.

At the end of the number of castings, C: 0.07%, Si: 0.27%, Mn: 1.51%, P: 0.0065%, S: 0.001%, Nb: 0.026%, Ti: 0.015%, V: 0.026%, Ni: 0.12%, Als: 0.020%; the consumption of this converter is: lime 47 kg/ton steel, total slag consumption 51.5 kg/ton steel, oxygen consumption 47.79 Nm3/ton steel, steel material consumption is 1.10 t/ton steel.

Five number of castings of steel are produced by the method of this example, the content of P in the steel are all less than 0.007 wt %, and after rolling, the resulting steel billet had a yield strength of 440-500 MPa, a tensile strength of 525-605 MPa, an impact energy of 130-190 J at −60 C, and the area shrinkage rate is 23-29%.

The invention claimed is:

1. A molten iron low-cost smelting method for polar steel, comprising successively:

converter smelting including smelting, deoxidizing and tapping alloying raw materials including molten iron;

LF refining including performing slag adjusting and refining on molten steel obtained in the converter smelting step to obtain a refined molten steel;

RH degassing including vacuum degassing the refined molten steel;

performing continuous casting on the molten steel obtained after the RH degassing to obtain a cast billet.

2. The molten iron low-cost smelting method for polar steel according to claim 1, wherein during the converter smelting if a content of a P element in the molten iron as a raw material is ≥0.15 wt %, a content of a Si element is 0.15-0.6 wt %, a content of a S element is ≤0.006 wt %, and a content of an As element is ≤0.006 wt %; and a temperature of the molten iron is ≥1230° C.

3. The molten iron low-cost smelting method for polar steel according to claim 1, wherein during the converter smelting, the smelting includes a double-slag process if a mass content of silicon in the molten iron as raw material is ≥0.30 wt %.

4. The molten iron low-cost smelting method for polar steel according to claim 1, wherein during the converter smelting, the smelting includes a single-slag process if a mass content of silicon in the molten iron as raw material is <0.30 wt %.

5. The molten iron low-cost smelting method for polar steel according to claim 1, wherein the converter smelting includes blowing nitrogen and argon at the bottom of the converter during the whole smelting process.

6. The molten iron low-cost smelting method for polar steel according to claim 1, wherein during the converter smelting, after the smelting and before the deoxidizing, using a high-low-low lance level to perform slag splashing and converter protection using nitrogen, repeatedly lifting lance during the slag splashing, after slag splashes dry, closing the nitrogen and lifting lance, and a time of the slag splashing is 140-200 s.

7. The molten iron low-cost smelting method for polar steel according to claim 1, wherein during the LF refining, substances used for the slag adjusting are aluminum slag and calcium carbide.

8. The molten iron low-cost smelting method for polar steel according to claim 1, wherein during the RH degassing, a degree of vacuum is ≤133 Pa, circulation time is not less than 15 minutes, and degassing time is greater than 5 minutes.

9. The molten iron low-cost smelting method for polar steel according to claim 1, wherein during the continuous casting, a superheat degree of the molten steel is controlled <25° C.

10. The molten iron low-cost smelting method for polar steel according to claim 1, wherein the content of P in the steel component obtained by the smelting method is less than 0.007 wt % by mass percentage.

11. The molten iron low-cost smelting method for polar steel according to claim 1, wherein during the converter smelting if a content of a P element in the molten iron as the raw material is ≥0.15 wt %, a content of an Si element is 0.15-0.6 wt %, a content of a S element is ≤0.006 wt %, and a content of an As element is ≤0.006 wt %; a temperature of the molten iron is ≥1230° C., the raw material comprises scrap steel; and a mass of scrap steel/(mass of molten iron+scrap steel) ≤8%.

12. The molten iron low-cost smelting method for polar steel according to claim 1, wherein during the converter smelting, the smelting includes a double-slag process if a mass content of silicon in the molten iron as raw material is ≤0.30 wt %, the double-slag process includes a first process including adding a part of slag to the raw material, and then blowing oxygen into the raw material with an oxygen lance, after a primary slag is completely smelted, taking the oxygen lance out of a converter and pouring the slag, and a second process including using the oxygen lance to blow oxygen into the molten steel, and then adding the remaining slag in batches, and continuing the smelting, measuring a temperature sampling carbon temperature and content of C of the molten steel, and selecting lime or sinter ore to be added according to a measurement result to ensure an alkalinity in a later stage and promote the slag smelting, during the second process, a predetermined time from adding the remaining slag to measuring the temperature sampling carbon temperature and content of C of the molten steel is 70-90 s, a total reaction time of the second process is 240-300 s, the slag includes a slag-forming agent and a coolant, the slag-forming agent is lime and dolomite, the coolant is sinter ore, and during the first process an addition amount of lime is 20-22.5 kg/ton steel, an addition amount of dolomite is 3.5-5.5 kg/ton steel, and an addition amount of sinter ore is 28.5-32 kg/ton steel, during the first process a time for blowing oxygen is 5-6 min, during the first process, after the primary slag is completely smelted, the oxygen lance is lifted out of a converter within 15-30 s, in the slag of the second process, an addition amount of lime is 21-25 kg/ton steel, an addition amount of dolomite is 3.5-5.0 kg/ton steel, and an addition amount of sinter ore is 14-20 kg/ton steel, during the second process, the temperature sampling carbon temperature is controlled to 1540° C.-1590° C., and a carbon content is controlled to 0.25 wt %-0.40 wt %, and during the second process, selecting to add lime or sinter ore to continue the blowing according to a measured temperature sampling carbon temperature result, so as to ensure that a temperature sampling oxygen temperature of the converter is controlled to 1600° C.-1650° C., and the carbon content is controlled to 0.07 wt %- 0.09 wt %, and performing spot blowing and temperature increasing if the temperature sampling oxygen temperature of the converter is less than 1600° C.

13. The molten iron low-cost smelting method for polar steel according to claim 1, wherein during the converter smelting, the smelting includes a single-slag process if a mass content of silicon in the molten iron as raw material is <0.30 wt %, the single-slag process includes a first step of adding lime, sinter ore and dolomite to the raw material, and a second step after the slag is completely smelted in the whole process, measuring a temperature sampling carbon temperature, and then selecting to add lime or sinter ore according to a measured temperature sampling carbon temperature result, during the first step, the lime is added in 2-3 batches, and an addition amount of ton steel is 42.9-46.2 kg/t, the sinter ore is added in 3-4 batches, an addition amount of ton steel is 39.2-42.8 kg/t, the dolomite is added in 2-3 batches, and an addition amount of ton steel is 8.57-10.7 kg/t, during the second step, an addition amount of the lime or sinter ore is 2.15-3.57 Kg per ton of the molten iron, if the temperature sampling carbon temperature is ≤1540° C., adding the lime and continuing oxygen blowing smelting, and if the temperature sampling carbon temperature is ≥1590° C., adding sinter ore, and during the second step, if a content of C is ≥0.10% according to a temperature sampling oxygen measurement result, performing spot blowing to control contents of C and P contents of the molten steel.

14. The molten iron low-cost smelting method for polar steel according to claim 1, wherein the converter smelting includes blowing nitrogen and argon at the bottom of a converter during the whole smelting process, during the converter smelting, in the first 7-8 minutes of smelting, blowing nitrogen at the bottom, a flow rate of nitrogen being 450-580 $Nm^3/h$ in a first 1-3 min, and the flow rate of nitrogen in a later stage is increased to 800-900 $Nm^3/h$, after bottom blowing nitrogen for 7-8 minutes in smelting, switching to argon, and increasing a flow rate of argon to 1000-1100 $Nm^3/h$, and if carbon-oxygen equilibrium of the converter is ≤0.0021 and carbon at a measuring end point of the converter is ≤0.045%, taping the steel directly, if the carbon-oxygen equilibrium of the converter is >0.0032, a temperature sampling oxygen composition of the converter is determined as C: 0.06-0.09 wt %, P≤0.006 wt %, S≤0.020 wt %, then the steel is tapped; if the carbon-oxygen equilibrium of the converter is between 0.0021-0.0032, the carbon at the measuring end point of the converter is ≤0.045%, otherwise, performing spot blowing.

15. The molten iron low-cost smelting method for polar steel according to claim 1, wherein during the converter smelting, after the smelting and before the deoxidizing, using a high-low-low lance level to perform slag splashing and converter protection using nitrogen, repeatedly lifting lance during the slag splashing, after slag splashes dry, closing the nitrogen and lifting lance, and a time of the slag splashing is 140-200 s the deoxidation is carried out by using ferro-manganese-aluminum, and an addition amount of the ferro-manganese-aluminum is 1.7-2.5 kg/t steel, and alloys used in the alloying include: metal manganese, ferrosilicon, ferroniobium, ferrovanadium and nickel plate.

16. The molten iron low-cost smelting method for polar steel according to claim 1, wherein during the LF refining, substances used for the slag adjusting are aluminum slag and calcium carbide, after the slag adjusting, an aluminum wire is fed for aluminum enrichment, and a titanium wire is fed for titanium enrichment, a time of the refining is 30-45 min, and a mass ratio of the slag used for the slag adjusting is: lime:fluorite:calcium carbide:aluminum slag=(3-5):(3-5):1:(1-2).

17. The molten iron low-cost smelting method for polar steel according to claim 1, wherein during the RH degassing, a degree of vacuum is ≤133 Pa, circulation time is not less than 15 minutes, and degassing time is greater than 5 minutes, and during the RH degassing, after the vacuum degassing, a calcium aluminum wire is fed at 80-100 m/converter, and blowing softly for not less than 10 minutes.

18. The molten iron low-cost smelting method for polar steel according to claim 1, wherein during the continuous casting, a superheat degree of the molten steel is controlled <25° C., during the continuous casting for a 175 mm section, a pulling speed during continuous casting is 1.25-1.35 m/min, for a 200 mm section, the pulling speed during continuous casting is 1.2-1.4 m/min; for a 250 mm section, the pulling speed during continuous casting is 1.1-1.3 m/min; and for a 300 mm section, the pulling speed during continuous casting is 0.85-0.95 m/min, and during the continuous casting, a crystallizer is made of peritectic steel to protect slag, a middle ladle is covered with a covering agent combined with carbonized rice husks to provide sufficient coverage of a liquid surface of the middle ladle, a long nozzle of a large ladle is sealed with argon, and a flow rate is 90-120 L/min.

* * * * *